United States Patent [19]

Small

[11] 4,398,595

[45] Aug. 16, 1983

[54] VORTEX GENERATORS

[75] Inventor: William M. Small, Bartlesville, Okla.

[73] Assignee: Phillips Petroleum Company, Bartlesville, Okla.

[21] Appl. No.: 413,104

[22] Filed: Aug. 30, 1982

Related U.S. Application Data

[62] Division of Ser. No. 264,529, May 18, 1981, which is a division of Ser. No. 98,576, Nov. 28, 1979, Pat. No. 4,311,187.

[51] Int. Cl.[3] ..... F28F 9/24

[52] U.S. Cl. ..... 165/109 R; 165/159; 165/162

[58] Field of Search ..... 165/109, 159, 161, 162, 165/172, 109 R, 109 T

[56] References Cited

U.S. PATENT DOCUMENTS

| | | | |
|---|---|---|---|
| 1,882,474 | 10/1932 | Black | 165/162 |
| 2,176,406 | 10/1939 | McCullough | 165/162 |
| 2,229,344 | 1/1941 | Schneider | 165/162 |
| 3,180,405 | 4/1965 | Hinde | 165/159 |
| 3,292,691 | 12/1966 | Welter et al. | 165/162 |
| 3,600,792 | 8/1971 | Valluy | 165/172 |
| 3,708,142 | 1/1973 | Small | 165/162 |
| 3,964,146 | 6/1976 | Vestre et al. | 165/162 |
| 3,967,677 | 7/1976 | Mohlman | 165/162 |
| 4,013,121 | 3/1977 | Berger et al. | 165/162 |
| 4,036,461 | 7/1977 | Soligno | 165/162 |
| 4,127,165 | 11/1978 | Small | 165/162 |
| 4,136,736 | 1/1979 | Small | 165/162 |
| 4,143,709 | 3/1979 | Cunningham | 165/172 |
| 4,203,906 | 5/1980 | Takada et al. | 165/159 |
| 4,204,570 | 5/1980 | Eisinger | 165/172 |
| 4,286,366 | 9/1981 | Vinyard | 29/157.4 |

FOREIGN PATENT DOCUMENTS

| | | | |
|---|---|---|---|
| 2823 | 12/1978 | European Pat. Off. . | |
| 845052 | 7/1952 | Fed. Rep. of Germany . | |
| 1294981 | 5/1969 | Fed. Rep. of Germany . | |
| 2706049 | 11/1977 | Fed. Rep. of Germany . | |
| 367842 | 4/1963 | Switzerland . | |
| 534605 | 3/1941 | United Kingdom . | |
| 764838 | 1/1957 | United Kingdom | 165/162 |
| 970722 | 9/1964 | United Kingdom . | |

OTHER PUBLICATIONS

Oberfell et al., Natural Gasoline, pp. 217–219, (1924).

*Primary Examiner*—Sheldon J. Richter

[57] ABSTRACT

The heat transfer coefficient of a tube bundle is improved by providing the bundle with at least one transverse vortex generating member.

11 Claims, 40 Drawing Figures

100
104a
98
4
5
26
102
3
2
25
93
110
108
104b
106

VORTEX GENERATORS

This application is a division of my copending application, Ser. No. 264,529, filed May 18, 1981, which is a copending division of my application Ser. No. 98,576, filed Nov. 28, 1979, now U.S. Pat. No. 4,311,187.

BACKGROUND OF THE INVENTION

The present invention relates to improving the heat transfer capabilities of a tube bundle to be used in a shell and tube heat exchanger. In another aspect, the invention relates to tightening a tube bundle to mitigate or eliminate damage caused by vibrations. In still another aspect, the invention relates to assembling a rigid tube bundle to mitigate or eliminate in-use damage to the bundle caused by vibrations. In still another aspect, the invention relates to a modified plate baffled tube bundle which has increased heat transfer with a minimal increase in pressure drop. In yet another aspect, the invention relates to novel heat exchanger baffles.

Heat transfer is an important part of any process. As is well known, an indirect transfer of heat from one medium to another is usually accomplished by the use of heat exchangers, of which there are many types. For example, there are double pipe, shell and tube, plate heat exchangers and others. Indeed, the art of heat exchanger design is developed to a very high degree. However, there is still room for improvement in a number of areas, such as in reducing pressure drop, increasing heat transfer coefficients, reducing fouling, and, especially in shell and tube exchangers to prevent damage resulting from vibrations, for example, wherein finned tubes and/or plate baffles are employed.

In most plate baffle type heat exchangers, the passages in the plate baffles through which the tubes pass are slightly larger in diameter than the outside diameter of the tubes in order to facilitate construction of the tube bundle. It is known that the heat transfer coefficient of such a bundle can be improved by employing finned tubes in the tube bundle. However, in a very popular species of finned tubes, the plain end diameter of the tube is larger than the diameter of the finned portion of the tube. Since the passages through the plates must be sufficiently large to permit passage of the plain end of the tube for construction of the exchanger, the result is an excessive space between the walls of the passages through the plates and the surface of the finned section of the tube. This excessive space permits tube vibration to occur when the heat exchanger is in use which frequently results in premature tube failure.

Rod baffles, such as disclosed in U.S. Pat. No. 4,136,736, provide the tubes in the tube bundle with complete radial support and substantially reduce tube damage caused by vibration. However, it has been difficult to construct a tube bundle using finned tubes with rod baffles to prevent vibratory damage of the tubes when the heat exchanger is utilized.

It would be desirable in tube bundles which employ plate baffles to further improve their heat transfer coefficient without incurring a substantial increase in pressure drop.

OBJECTS OF THE INVENTION

It is an object of this invention to improve the heat transfer capability of a tube bundle.

It is a further object of this invention to support the tubes of a tube bundle.

It is another object of this invention to assemble a tube bundle in which the tubes are supported.

It is another object of this invention to tighten a tube bundle in which the tubes are not radially supported.

It is another object of this invention to provide heat exchanger baffles to support the tubes of a tube bundle and provide the bundle with a high heat transfer coefficient and low pressure drop when the tube bundle is employed in a heat exchanger.

It is another object of this invention to accomplish the above objects when employing a tube bundle comprising finned tubes.

It is another object of this invention to radially support the tubes of a tube bundle built with finned tubes.

It is another object of this invention to radially support the tubes of a tube bundle built with finned tubes having plain ends with a larger outside diameter than the finned section.

SUMMARY OF THE INVENTION

According to the invention, a tube bundle having a plurality of tubes geometrically arranged between two tube sheets in at least a first and a second plurality of parallel tube rows with lanes between the rows is provided with at least one non-supportive vortex generator extending at least partially across the tube bundle in at least one of the lanes defined between the rows of parallel tubes.

Further, according to the invention, a tightly constructed tube bundle is assembled by inserting a plurality of tubes through a ring having a plurality of vortex generators affixed thereto as a plurality of parallel chords to form a plurality of parallel tube rows parallel to the plurality of parallel vortex generators and inserting a second plurality of vortex generators between the parallel tube rows to wedge at least a portion of the parallel tube rows between a vortex generator of the first plurality and a vortex generator of the second plurality.

Still further, according to the invention, a tube bundle is provided which comprises a plurality of parallel tubes arranged to form at least a first and a second plurality of parallel tube rows at least partially surrounded by a ring which has affixed thereto as a chord at least one non-supportive vortex generator which passes between two adjacent rows of tubes.

Thus, according to the invention, the heat transfer in a heat exchanger can be dramatically increased with only minimal increase in pressure drop. A tight tube bundle can be constructed or a loose tube bundle tightened by a simple inexpensive procedure which increases the heat transfer coefficient of the tube bundle in addition to providing a safeguard against tube failure due to vibratory damage. The heat transfer coefficient of the tube bundle can be even further increased by employing finned tubes, combined into a rigid tube bundle highly resistant to vibratory damage in accordance with the invention. These and other advantages and aspects are more fully explained in the following detailed description of the invention, the drawings, and the appended claims.

DETAILED DESCRIPTION OF THE PREFERRED EMBODIMENTS

In accordance with the present invention, it has been found that heat transfer rates can be increased in most any shell and tube heat exchanger with only minimal increases in pressure drop by providing at least one vortex generator at least partially across at least one of the flow lanes in the tube bundle. As used herein, a vortex generator is simply an element which acts upon fluid flowing in the shell side of a heat exchanger to form vortex streets in a downstream direction as measured by the flow of the shell side fluid from the vortex generator. Thus a vortex generator as used herein includes supportive elements such as rods used to form the rod baffles described in U.S. Pat. No. 4,136,736 issued to W. M. Small on January 30, 1979 as well as non-supportive elements such as rods which have a diameter smaller than the space between adjacent rows of tubes. The vortex generators of the present invention preferably pass through the tube bundle in at least one plane which is about normal to the longitudinal axis of the bundle, because of ease of construction. The vortex generators can, however, be employed in at least one plane which forms an acute angle with a plane normal to the longitudinal axis of the bundle, and in such situations, the pressure drop increase will be even more minimized. Because the purpose of the vortex generators is to form a vortex streets, an area of turbulence which extends in the plane running downstream from a vortex generator, the vortex generator must exhibit a vortex generating cross section in the plane defined by the direction of fluid flow and a line normal to both the direction of fluid flow and the longitudinal axis of the vortex generator. A circular cross section of the vortex generator is preferred, because such has been tested with good results and material from which such a vortex generator can be constructed is readily available. Further it is presently believed that vortex generators with a circular cross section are the most cost effective. Other suitable forms of vortex generators include those which exhibit a convex cross-sectional surface, for example, oval, tear drop, and knife-like cross sections.

Figure 1:
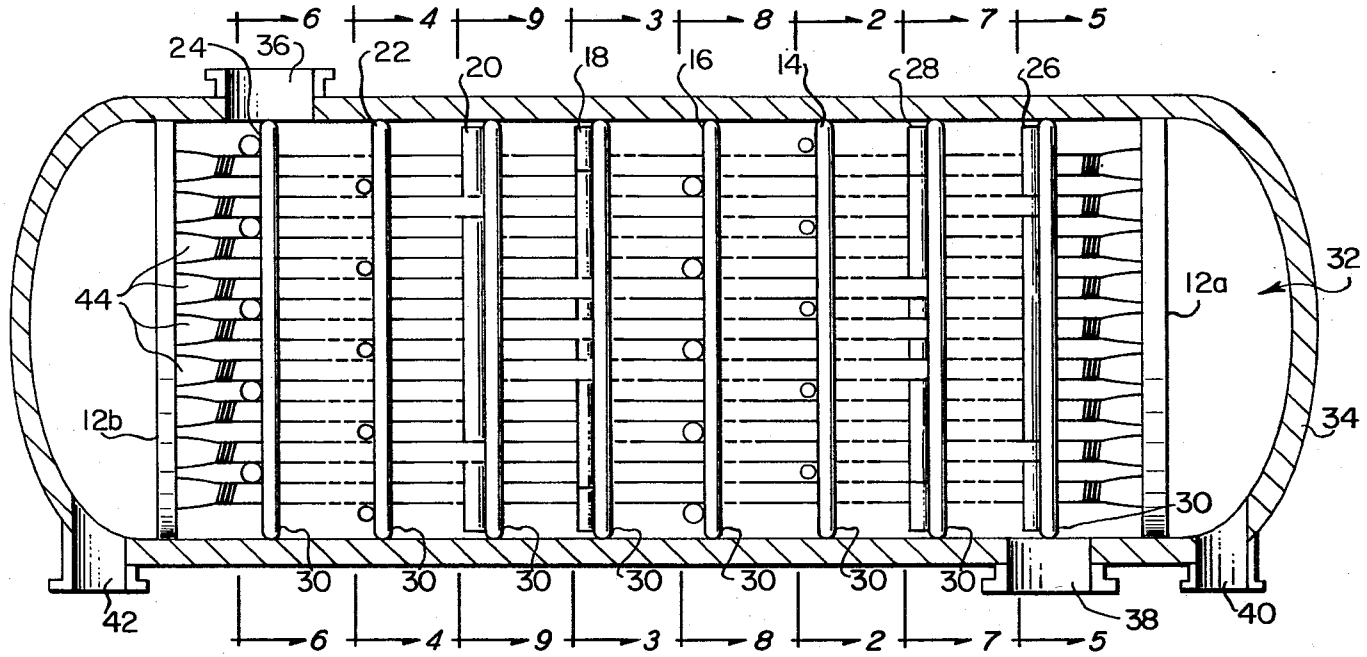
FIG. 1 illustrates an embodiment of the present invention employed in a shell and tube heat exchanger having finned tubes with the shell taken in cross section.
Figure 2:
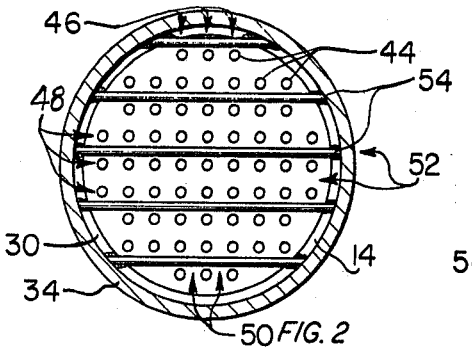
FIGS. 2–9 represent elevational views of the baffles in the heat exchanger of FIG. 1 as seen along the indicated lines.
Figure 4:
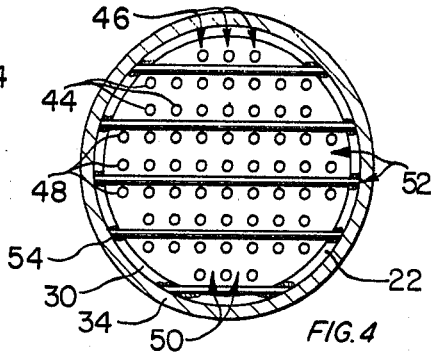
Figure 3:
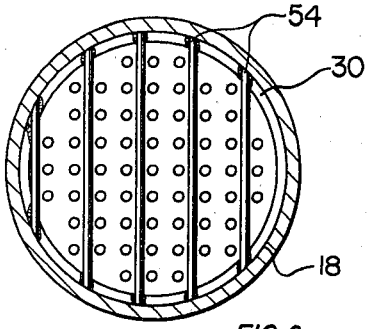
Figure 5:
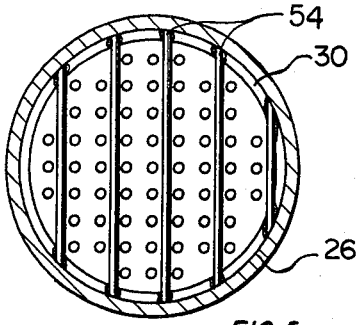

Referring to FIG. 1, a heat exchanger, denoted generally by the reference numeral 10 has two tube sheets **12*a* and 12*b* and 8 baffles, 14, 16, 18, 20, 22, 24, 26 and 28. Each of the baffles comprises a ring 30 which at least partially surrounds a tube handle 32 which is positioned within a heat exchanger shell 34. As shown, each of the baffles 14–28 is perpendicular to the longitudinal axis of the tube bundle 32, but, as indicated earlier, it is possible and sometimes even desirable, to employ baffles which are not in a plane perpendicular to the longitudinal axis of tube bundle 32. The shell side of heat exchanger 10 has an inlet nozzle 36 and an outlet nozzle 38 to permit a first fluid to pass over the outside surface of a plurality of tubes 44 and the tube side of heat exchanger 10 has inlet nozzle 40 and outlet nozzle 42 to permit a second fluid to pass over the inside surface of the tubes 44 employing countercurrent flow of heat exchange mediums. Tubes 44 of tube bundle 32 are laid out between tube sheets 12*a* and 12*b* in a geometrical pattern, square pitch as illustrated, as is most clearly shown in FIGS. 2–9. Each tube 44 as illustrated is a finned tube having plain ends of a larger diameter than the finned portion of the tube and affixed by its plain ends to tube sheets 12*a* and 12*b***.

Figure 6:
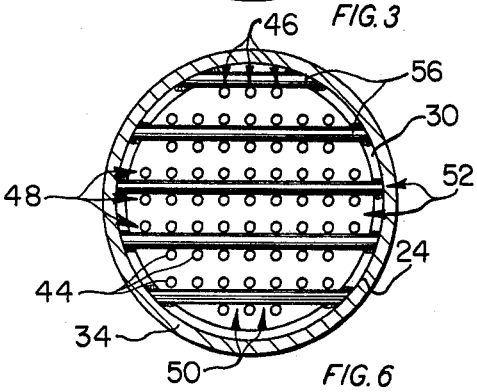
Figure 8:
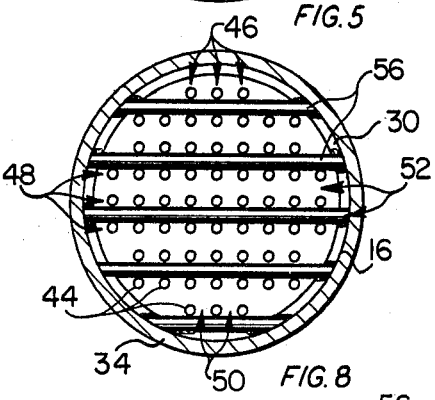
Figure 7:
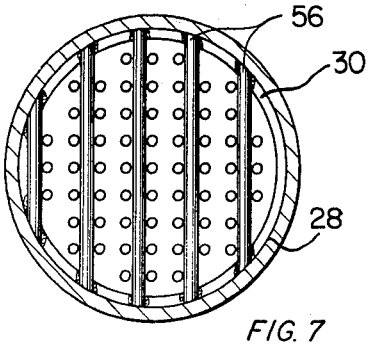
Figure 9:
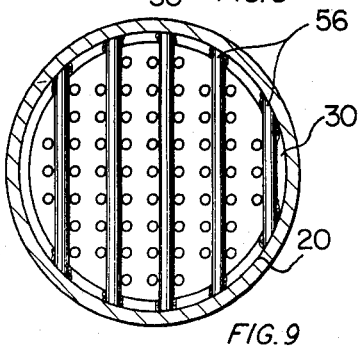

Referring now to FIGS. 2–9, it is seen that tubes 44 are arranged in at least sets of parallel tube rows 46 and 48, with at least two parallel sets of lanes 50 and 52 defined between the rows. Baffles 14, 18, 22 and 26 are identical, differing only in their orientation with respect to the bundle 32 with rotation in multiples of 90°. Baffles 16, 20, 24 and 28 are also identical and similarly oriented. In baffles 14, 18, 22 and 26, non-supportive vortex generators 54 are affixed to ring 30 as chords as in FIG. 3. Vortex generators 54 do not touch or support tubes 44 and each rod 54 serves to generate vortex streets for the tube bundle 32 shown in cross section in FIGS. 2–9 as the array of small circles. The plurality of parallel vortex generators 54 extend substantially across tube bundle 32 and in combination with ring 30 form the non-supportive rod baffles 14, 18, 22 and 26. In baffles 16, 20, 24 and 28, supportive vortex generators 56 are affixed to rings 30 as chords as shown in FIG. 6. Vortex generators 56 touch and support a portion of the tubes 44 and together the vortex generators 56 in supportive rod baffles 16, 20, 24 and 28 provide radial support for tubes 44, restraining them from movement in any direction perpendicular to their longitudinal axes as well as generating vortex streets.

It is not necessary for the vortex generators 54 or 56 affixed as chords to a ring 30 to pass through each parallel lane in a set of parallel lanes. By employing a set of supportive rod baffles such as baffles 16, 20, 24 and 28 and a 90° rotational scheme, it is possible and in fact preferred, because of lower pressure drop, that the vortex generators 56 of each supportive rod baffle 16, 20, 24, and 28 pass through only a substantially small fraction of the parallel lanes 50 or 52 in a set of parallel lanes, such as illustrated, about one-half.

In the embodiment shown in FIG. 1, alternating supportive rod baffles and alternating non-supportive rod baffles are employed to support the tubes of tube bundle 32 and provide vortex streets to increase the heat transfer coefficient of tube bundle 32. Those skilled in the art will immediately recognize that the number of tubes 44 comprising bundle 32 and the number of baffles employed in combination with bundle 32 are abnormally small. A commercial heat exchanger would comprise, for example, 1000 tubes 44, and the baffles would be spaced 2–18 inches apart, depending on the heat exchanger purpose for which the bundle was to be employed. For example, it would be desirable when employing the tube bundle 32 in a heat exchanger 10 for cooling gases to provide rod baffles from about 2 to about 10 inches apart, usually about 6 inches apart, while in a reboiler, the spacing between the rod baffles could be from about 6 to about 18 inches apart, usually about 12 inches. Obviously, the number of rod baffles employed in a commercial scale tube bundle 32 could be, and usually is, a great many more than the 8 as illustrated in FIG. 1.

The diameter of the non-supportive vortex generators 54 is of course, less than the width of the lanes 50 or 52 through which they pass. The diameter of the supportive vortex generators 56 is about equal to the width of the lanes 50 or 52 through which they pass. Preferably, the diameter of the non-supportive vortex generators 54 in this embodiment is between about 5 and 95% of the width of the lanes 50 or 52 through which they pass. Vortex generators 54 with a diameter near the smaller end of this range have an advantage in that they do not greatly increase pressure drop, and vortex generators 54 with a diameter near the larger end of this range have an advantage in that they better help prevent tube 44 collision between the supportive rod baffles 16, 20, 24 and 28, which, of course, allows the baffles to be placed further apart to at least partially offset the increased pressure drop caused by employing the relatively large diameter vortex generators 54.

It is important when designing an apparatus in accordance with this embodiment of the invention to note that fluid on the shell side of the apparatus flows essentially in a direction parallel to the longitudinal axis of the tube bundle. To maintain shell side fluid in a heat exchange relationship with the fluid inside the tubes 44, it is important that the fluid be forced to flow down the lanes 50 and 52 defined by the parallel tube rows 46 and 48, rather than, for example, between the tube bundle 32 and the heat exchanger shell 34. For this reason, rings 30 should restrict the flow of shell side fluid between the shell 34 and the tube bundle 32.

Referring now to FIGS. 10–18, an embodiment of the present invention is illustrated wherein both supportive vortex generators and non-supportive vortex generators are employed in combination with the same ring to both support the tubes and improve heat transfer with only a small increase in pressure drop.

Figure 10:
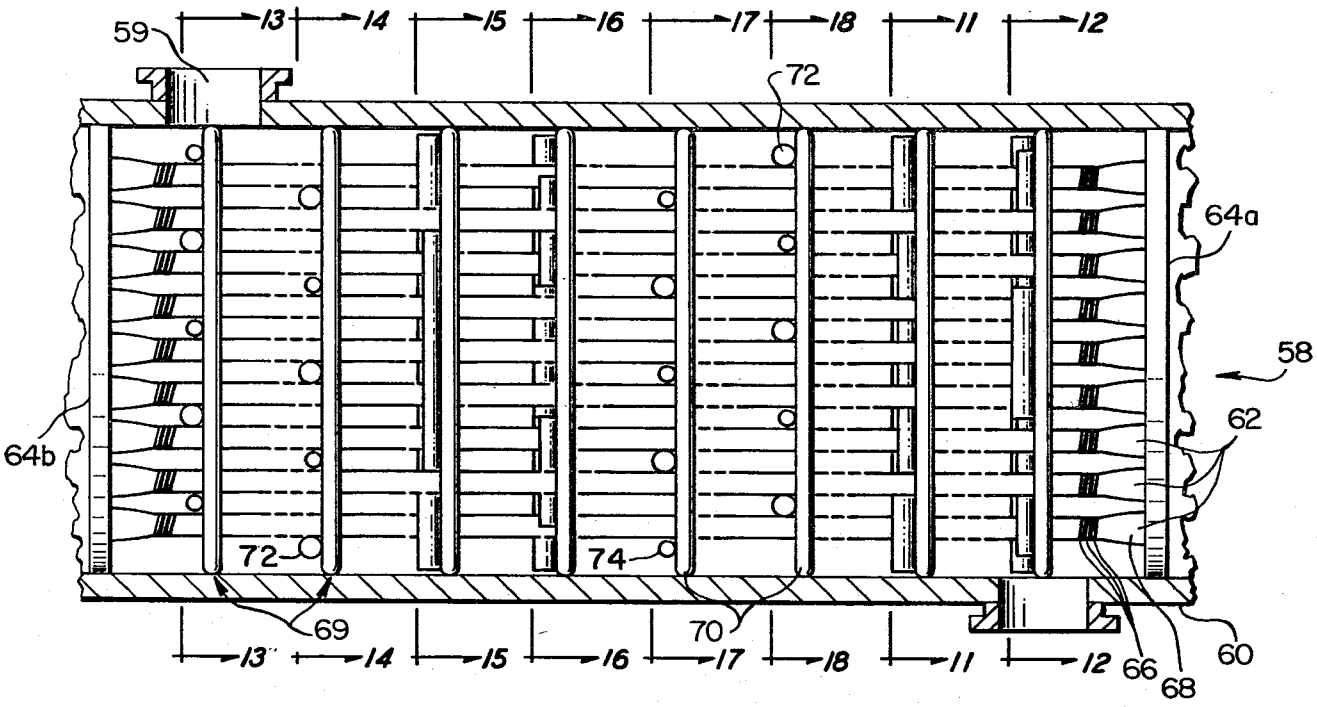
FIG. 10 illustrates another embodiment of the present invention employed in a tube bundle having finned tubes situated in a portion of a heat exchanger shell.
Figure 18:
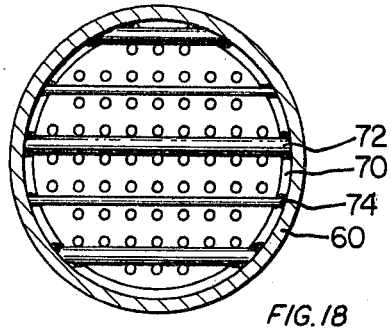
FIGS. 11–18 represent elevational views of the baffles of the invention shown in FIG. 10 as seen along the indicated lines.
Figure 17:
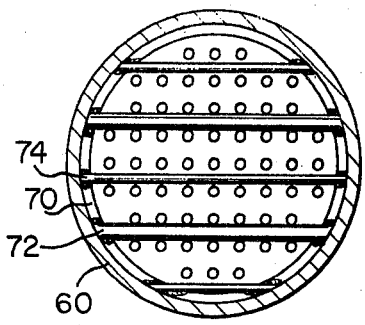
Figure 11:
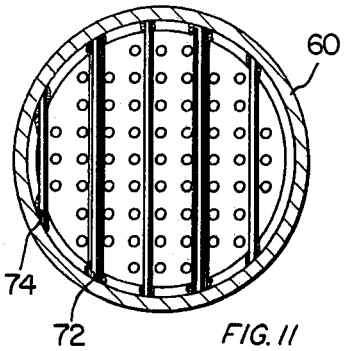
Figure 15:
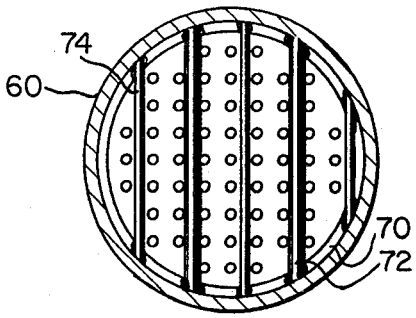
Figure 13:
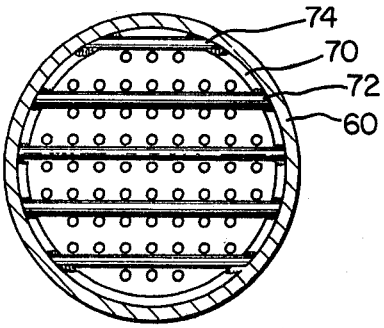
Figure 14:
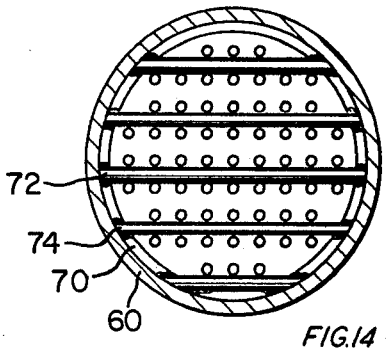
Figure 16:
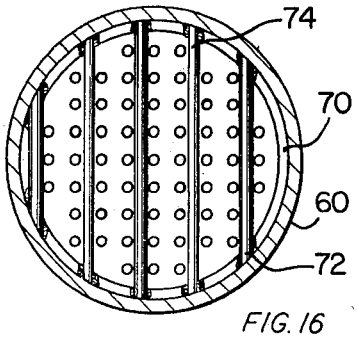
Figure 12:
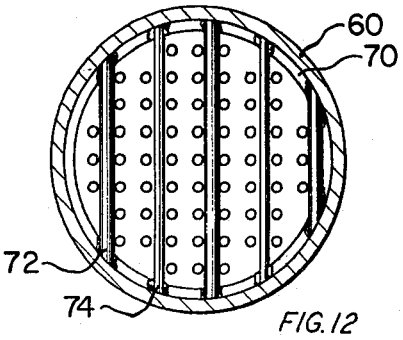

Referring to FIG. 10, a tube bundle 58 is shown in a portion of a heat exchanger shell 60 equipped with an inlet nozzle 59 and an outlet nozzle 61. A plurality of tubes 62 are arranged between two tube sheets **64*a* and 64*b* in a geometric pattern of parallel tube rows. Each of the tubes 62 is a finned tube having annular ridges 66 which extend substantially its full length. An enlarged plain end portion 68 is provided at each end of each tube 62. Plain end portions 68 have a diameter larger than the diameter of the tube 62 along the ridged or finned portion intermediate the end portions 68, so that the exterior surface of the tubes 62 at their end portions will fit tightly against the interior surface of the apertures through the tube sheets 64*a* and 64*b***.

During assembly of a tube bundle, the baffles are usually assembled first and arranged into the desired positions as a cage and the tubes are pressed longitudinally into the cage. It has proved difficult to construct a tight bundle of above-described finned tubes to prevent vibratory damage during employment of the tube bundle particularly where the fins are of a soft metal such as copper because the fins bend easily. As used herein, a tight bundle means that the tubes are radially supported, and movement in a direction perpendicular to the longitudinal axis of each tube in the bundle is greatly hindered. The problem encountered in the prior art was that the enlarged end portions of each tube could not be passed through an aperture small enough so that its interior surface provided support against the exterior surface of the middle of the tube. Because of this, tube bundles comprising finned tubes were often loose and subject to tube failure due to impact damage suffered during tube vibrations.

In the embodiment of the invention shown in FIG. 10, each rod baffle 69 comprises a ring 70, at least one supportive vortex generator 72 affixed as a chord to ring 70, and at least one non-supportive vortex generator 74 affixed as a chord to ring 70. The supportive vortex generators 72 are preferably of a diameter about the same as the width of the lanes defined between two adjacent rows of tubes. The non-supportive vortex generators 74 have a diameter which is smaller than the diameter of the supportive vortex generators, for example, about 80% of the diameter of the supportive vortex generators. The spacing between the rod baffles is sufficiently great so that the enlarged plain end portion 68 of each finned tube 62 can be snaked through each rod baffle in the baffle cage during assembly of the bundle. The vortex generators in each rod baffle must, of course, not be closer together than the diameter of the plain end portion 68 of the tubes 62 or the tubes could not be inserted into the cage. As shown in FIG. 10, the vortex generators 72 and 74 in a rod baffle cross only about in one-half of the lanes defined by a plurality of parallel tube rows. Alternate lanes are occupied by a vortex generator, and vortex generators adjacent each other in the same rod baffle are non-identical. In the embodiment shown, 8 rod baffles provide a rod baffle set which gives radial support to each tube in the tube bundle. The spacing between adjacent rod baffles is generally about 4–15 inches. Spacing the rod baffles near the lower end of this range provides a very sturdy tube bundle, while rod baffle spacing near the upper end of the range eases assembly of the bundle and does not provide as large an increase in pressure drop.

Referring to FIGS. 11–18, it is seen that the rod baffles of FIGS. 11, 13, 15, and 17, hereinafter referred to as type "A" rod baffles, are identical, differing from each other only in orientation, and that the rod baffles of FIGS. 12, 14, 16 and 18, hereinafter referred to as type "B" rod baffles, are also identical.

As shown, the type "A" and type "B" rod baffles alternate along the length of the tube bundle, although other arrangements can be used as well. Type A and type B rod baffles differ in the placement of their supportive and non-supportive vortex generators, which occupy exchanged positions between the two rod baffles. In both type "A" and type "B" rod baffles as shown, the vortex generators pass through alternating lanes, and adjacent vortex generators 72 and 74 in the same rod baffle have different diameters. A type "B" rod baffle is merely a type "A" rod baffle in which supportive vortex generators 72 are employed in place of the non-supportive vortex generators 74 and vice versa. The placement scheme of the vortex generators is especially well suited for symmetric tube bundles having an odd number of tube rows in a plurality of parallel tube rows.

It is desirable that the rod baffle adjacent the inlet nozzle 59 for the shell side fluid be oriented to split the incoming fluid. Normally, this can be accomplished by orienting this rod baffle into a position so that its rods are normal to the direction taken by the incoming fluid.

Referring now to FIGS. 19–23, there is shown a preferred rod and baffle scheme for a tube bundle comprising the previously described finned tubes. A portion of a tube bundle 74 comprising a plurality of finned tubes 76 is shown in a portion of a heat exchanger shell 78 equipped with an inlet nozzle 79. Each finned tube 76 has an enlarged plain end portion 80 without fins firmly mounted in an aperture through a tube sheet 82. The tubes 76 are arranged in at least two pluralities of parallel tube rows by tube sheet 82. There is a plurality of parallel lanes defined by each plurality of parallel tube rows. The tube bundle 74 includes a series of rod baffles 84, 86, 88, and 90, each of which comprises a ring 92 at least partially encircling the tube bundle 74 and fitting preferably close to the interior surface of the heat exchanger shell 78. Pluralities of larger vortex generators 94 and smaller vortex generators 96 are affixed by their ends as chords to each ring 92. Rod baffle 84, which is adjacent the inlet nozzle 79 is oriented so as to split the stream of incoming fluid.

In this embodiment of the invention, vortex generators are affixed to both the upstream and downstream ends of each ring, by any suitable means, such as welding. Each ring 92 can have any suitable length along the axis of the heat exchanger. For example, for some applications it may be desirable to employ rings having 6 inch lengths with a baffle spacing of 12 inches. As shown, the smaller diameter vortex generators 96 are affixed to the upstream end of the ring and the larger diameter vortex generators 94 are affixed to the downstream end of the ring, although this relationship can be reversed if desired. In fact, in situations where pressure drop is very critical, it can be desirable to eliminate the smaller diameter vortex generators 96 immediately upstream of and in the same rod baffle as a larger vortex generator 94, and optionally moving the larger vortex generator to the upstream end of the ring.

Rod baffles 84 and 88, hereinafter type "A" rod baffles are identical, differing only in their orientation. Rod baffles 86 and 90 hereinafter type "B" rod baffles are also identical, differing only in their orientation. Together, the four rod baffles comprise a rod baffle set which provides each tube of the tube bundle 74 with complete radial support. The tube bundle 74 is constructed by fastening the smaller vortex generators to the ring as in the type "A" and type "B" rod baffles. The rod baffles are sequentially arranged to form a cage. The tubes are inserted into the cage to form a loose bundle. The loose bundle is tightened by inserting the larger vortex generators and affixing them to one of the rings 90 to firmly wedge each tube 76 between a larger vortex generator 94 and a smaller vortex generator 96.

The diameter of the smaller vortex generators 96 is less than the width of a lane between two adjacent parallel tube rows. In the embodiment shown, the diameter of the smaller vortex generators 96 must be small enough to allow the passage of the enlarged plain end portion 80 of a finned tube 76 between smaller vortex generators 96 occupying adjacent lanes. The diameter of the larger vortex generators 94 is greater than the width of a lane between two adjacent parallel tube rows. The diameter of a smaller vortex generators 96 plus the diameter of a larger vortex generator 94 should equal about twice the width of a lane between two adjacent parallel tube rows, so that insertion of the larger vortex generators 94 will distort the tubes 76 sufficiently to wedge them firmly against the smaller vortex generators 96. The larger vortex generators 94 can be driven in if necessary. Tube damage caused by the flattening of the soft fins during assembly is minimized or virtually eliminated by following this procedure, and a very tight tube bundle can be constructed. Normally, the diameter of the smaller vortex generators 96 in this embodiment will be 50% or greater of the diameter of the larger vortex generators 94.

In both the type "A" and type "B" rod baffles of this embodiment of the invention, the smaller vortex generators 96 occupy alternating pairs of adjacent lanes between parallel tube rows. The rod baffles differ in that the smaller vortex generators of the type "B" rod baffle occupy lanes not occupied by the smaller vortex generators of the type "A" rod baffle when both rod baffles are oriented so that their vortex generators traverse lanes defined by the same plurality of parallel tube rows, and vice versa. In both types of rod baffles, the larger vortex generators 94 are affixed on the opposite side of the ring 92 from the smaller vortex generators. The larger vortex generator 94 is positioned in the same lane as a smaller vortex generator 96 on the opposite side of the ring 92, and wedges a row of tubes 76 against a smaller vortex generator 96 in the same rod baffle, and another row of tubes 76 against a smaller vortex generator 96 in a different rod baffle. The smaller vortex generators 96 not contacting a row of tubes function to generate vortex streets and improve heat transfer. The smaller vortex generators 96 which contact a row of tubes 76 support the tubes 76 with only a small increase in pressure drop. The larger vortex generators 94 in an individual rod baffle pass through substantially less than one-half, and, as illustrated only about one-quarter of the lanes defined by a plurality of parallel tube rows, and thus function to support the tubes with only a small increase in pressure drop.

Figures 24, 25, 26:
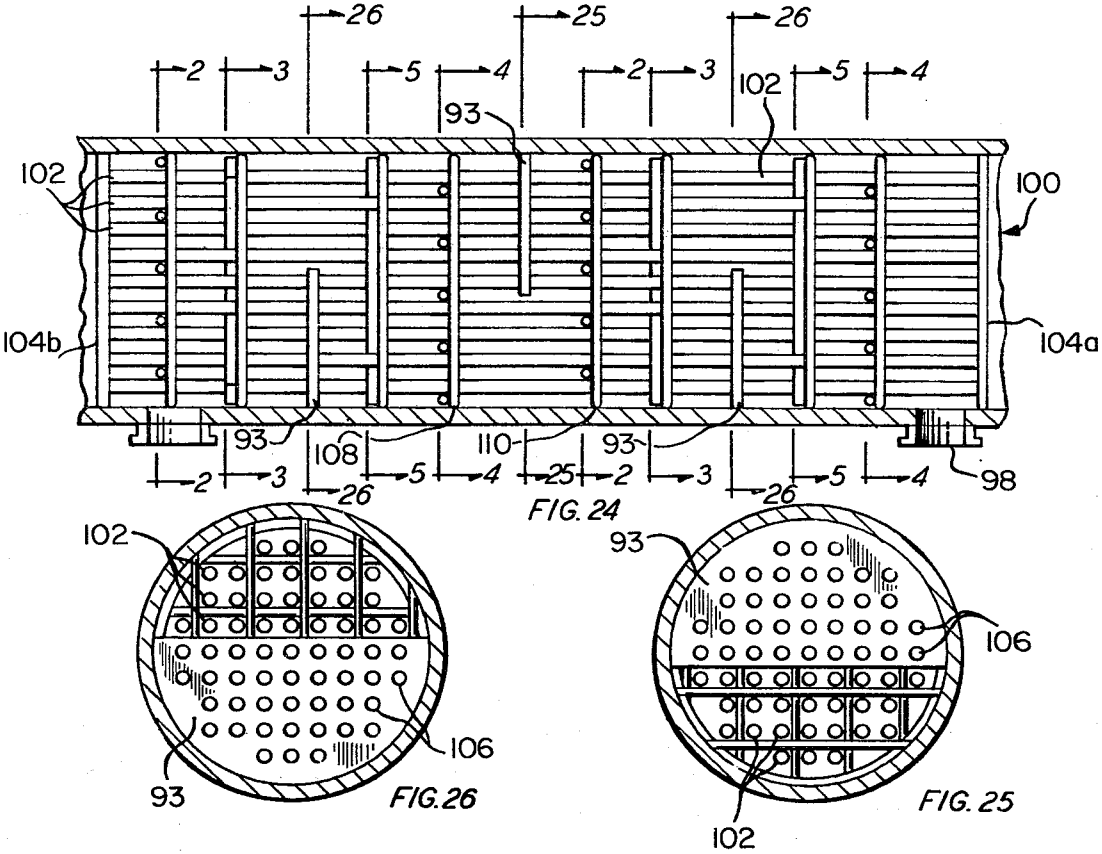
FIG. 24 illustrates another embodiment of the present invention wherein vortex generators in the form of non-supportive rod baffles are employed in combination with segmental plate baffles in a shell and tube heat exchanger.
FIGS. 25 and 26 are cross sections of the apparatus shown in FIG. 24 taken along the indicated lines.

Referring now to FIGS. 24–26, there is illustrated an embodiment of the present invention wherein non-supportive vortex generator rod baffles are employed in combination with alternating segmented plate baffles 93. A portion of a heat exchanger shell 95 equipped with an inlet nozzle 97 and an outlet nozzle 98 encases a tube bundle 100 comprising a plurality of parallel tubes 102 mounted between two tube sheets **104*a* and 104*b*. Each segmental plate baffle 93 has a plurality of apertures 106 therethrough for passage of a portion of the tubes 102. The apertures 106 are only slightly larger than the diameter of the tubes 102 and function to partially support the tubes as well as to force the fluid which flows from inlet nozzle 97 to outlet nozzle 98 to follow a tortuous path and sweep across the tubes 102. Normally, each alternating segmental plate baffle 92** effectively blocks between 40% and 80% of the area of the fluid flow passages defined between the parallel tube rows.

The tube bundle 100 is also equipped with a plurality of vortex generator rod baffles, as shown in FIGS. 2–5. The diameter of the vortex generators in a rod baffle is less than the width of the lanes between the rows of parallel tubes. Preferably, the diameter of the vortex generators is between about 75 and 95% of the width of the lanes between parallel tube rows to act as a cushion to prevent tube 102 collision due to tube vibrations along the tube span between the segmental plate baffles 93. In the embodiment shown, two rod baffles are placed between adjacent segmental plate baffles 93, although it is to be understood that any number of rod baffles can be placed between the segmental plate baffles 93, subject only to space limitations. When employing the non-supportive rod baffles in combination plate baffles, it is desirable that at least some of the non-supportive vortex generators be oriented perpendicular to the fluid velocity, to further improve heat transfer. This aspect of the invention is shown best in FIG. 24 as the relationship between rod baffles 108 and 110 and the plate baffle 93 situated therebetween. As the shell side fluid is forced across the tubes 102 because of the central most plate baffle 93, the vortex generators in rod baffle 108 create high turbulence vortex streets in a downstream direction around the end of plate baffle 93 and further improve the heat transfer coefficient of the tube bundle. If desired, all of the non-supportive vortex generators in cooperation with the tube bundle 100 can be oriented similar to rod baffles 108 and 110 to further improve the heat transfer coefficient of the tube bundle. Further, if desired, the non-supportive vortex generators of a single rod baffle in such a rod baffle arrangement can extend through each of the lanes defined by the parallel tube rows.

Figure 27:
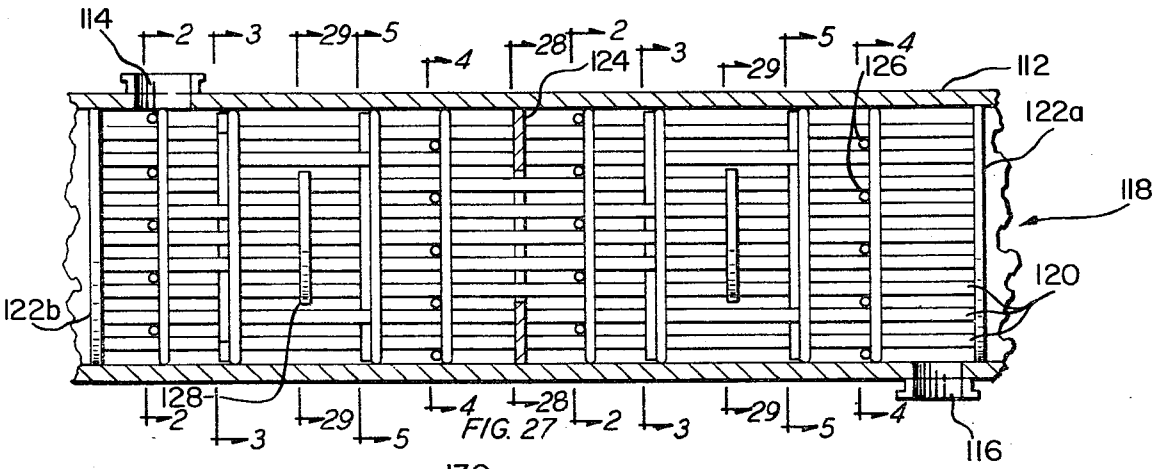
FIG. 27 illustrates another embodiment of the present invention wherein vortex generators in the form of non-supportive rod baffles are employed in combination with disc and doughnut plate baffles in a shell and tube heat exchanger.
Figure 28:
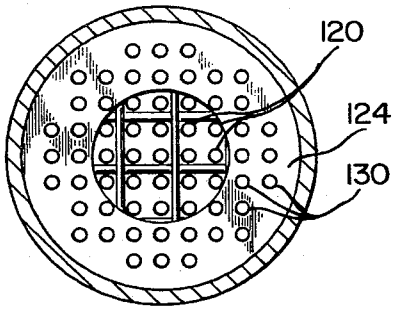
FIGS. 28 and 29 are cross sections of the apparatus shown in FIG. 27 taken along the indicated lines.
Figure 29:
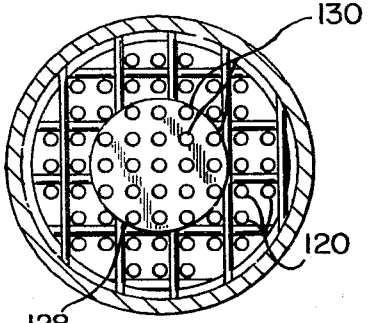

In the embodiment of the invention shown in FIGS. 27–29, non-supportive rod baffles are employed in combination with disc and doughnut plate baffles. A portion of heat exchanger shell 112 equipped with inlet nozzle 114 and outlet nozzle 116 encases a tube bundle 118 comprising a plurality of parallel tubes 120 mounted between two tube sheets **122*a* and 122*b*. The tube bundle is equipped with a doughnut baffle 124 and two disc baffles 128 each of which has a plurality of apertures 130 for passage of a portion of tubes 120 therethrough. The bundle further comprises a plurality of non-supportive vortex generator rod baffles having non-supportive vortex generators extending at least partially across the tube bundle 118. The non-supportive rod baffles employed are as illustrated in FIGS. 2–5. In this embodiment of the invention, shell side fluid flowing across the tubes 120 has a velocity component radial to the longitudinal axis of the tube bundle 118. It is therefore desirable that the vortex generators in this embodiment of the invention be placed in more than one of the pluralities of lanes defined by the pluralities of parallel tube rows, to that at least most of the tubes 120 in the tube bundle 18** are contacted by vortex streets from a vortex generator oriented perpendicularly to the direction of fluid flow.

In the embodiment shown in FIGS. 24 through 29 all of the non-supportive rod baffles can have the vortex generators positioned in parallel lanes in one plurality of parallel lanes and preferably with the vortex generators of one non-supportive rod baffle in different parallel lanes as compared to the vortex generators of the next adjacent non-supportive rod baffle.

Figure 30:
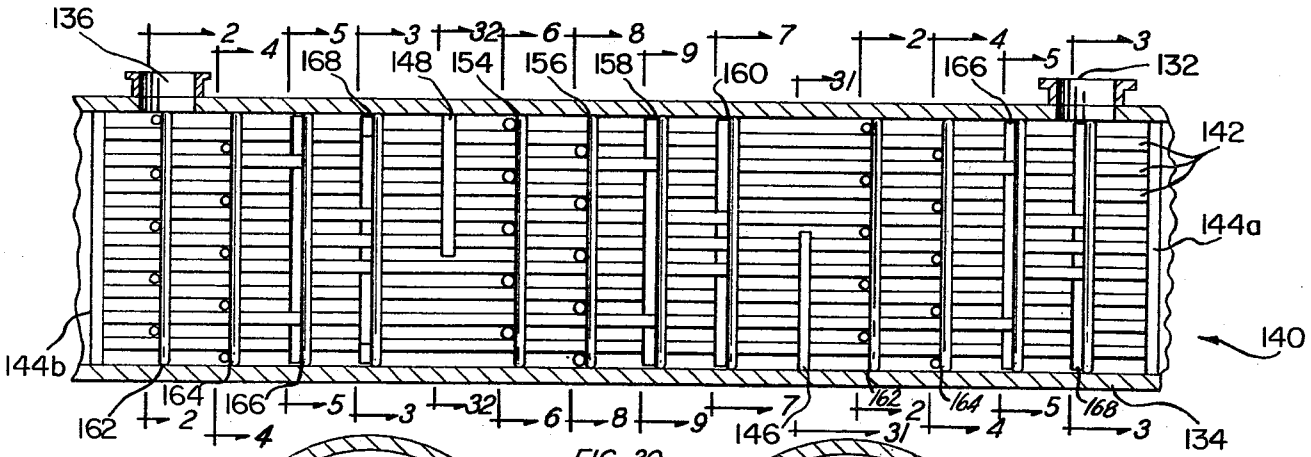
FIG. 30 illustrates another embodiment of the present invention wherein vortex generators in the form of supportive and non-supportive rod baffles are employed in combination with plate baffles in a shell and tube heat exchanger.
Figure 31:
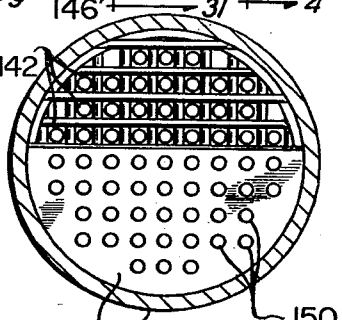
FIGS. 31 and 32 are cross sections of the apparatus shown in FIG. 30 taken along the indicated lines.
Figure 32:
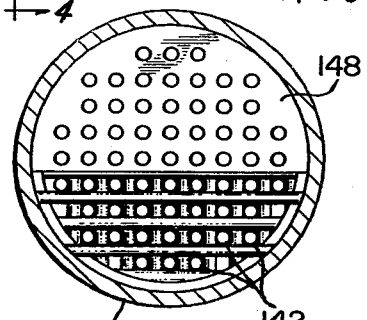

In the embodiment of the invention shown in FIGS. 30–32, a plate-baffled shell and tube heat exchanger is provided with supportive rod baffles to enhance structural integrity as well as heat transfer and non-supportive rod baffles to improve heat transfer. A portion of heat exchanger shell 134 equipped with inlet nozzle 136 and outlet nozzle 138 encases a tube bundle 140 comprising a plurality of parallel tubes 142 arranged in at least two pluralities of parallel tube rows between tube sheets **144*a* and 144*b*. The tube bundle 40 is equipped with alternating segmental plate baffles 146 and 148 each of which is in the shape of a cut disc and has a plurality of apertures 150 therethrough for passage of a portion of tubes 142 therethrough. The tube bundle 140 is further provided with a set of supportive rod baffles 154, 156, 158 and 160, and two sets of non-supportive rod baffles 162, 164, 166, and 168. The supportive rod baffle set is as shown in FIGS. 6–9, and the non-supportive baffle set are as shown in FIGS. 2–5**. A commercial heat exchanger could employ alternating supportive rod baffle sets and non-supportive rod baffle sets with an alternating plate baffle in between the two sets. This baffling scheme reduces the unsupported tube spans between similarly oriented plate baffles by about 25%. The non-supportive rod baffles help prevent tube collisions along the unsupported tube spans in addition to generating vortex streets to increase heat transfer in the exchanger.

FIGS. 33–40 illustrate exemplary rod baffles of the present invention. For ease of understanding, the baffles are shown in a shell and tube heat exchanger environment, with shell cross-sectional 170 and tubes 172 of a tube bundle within the shell.

Figure 33:
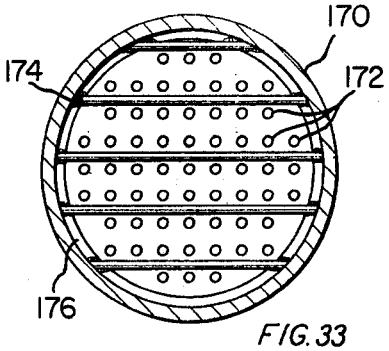
FIGS. 33–40 illustrate further embodiments of the inventive vortex generator baffles of the present invention.

Referring to FIG. 33, non-supportive vortex generators 174 are affixed as chords to ring 176 by any suitable means to form a non-supportive rod baffle. As illustrated vortex generators 174 are welded to one end of ring 176. The vortex generators 174 extend through the tube bundle in alternating horizontal lanes defined by adjacent tube rows.

Figure 35:
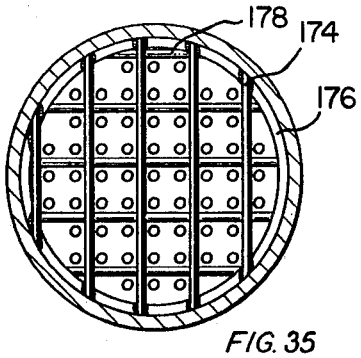

In FIG. 35, non-supportive vortex generators 174 are affixed as chords to both ends of ring 176 to form a non-supportive rod baffle. On one end of ring 176, the vortex generators 174 extend through the tube bundle in alternating horizontal lanes defined by adjacent tube rows, and on the other end of the ring, the vortex generators extend through the tube bundle in alternating vertical lanes defined by adjacent tube rows. This particular rod baffle is believed to be especially well suited for combination with disc and doughnut type plate baffles, because the vortex generators are well oriented for generating vortex streets when there is a radial component in the flow of shell side fluid. The ring 176 can have any desired length in this embodiment of the invention, for example, from about 1 to about 12 inches.

Figure 36:
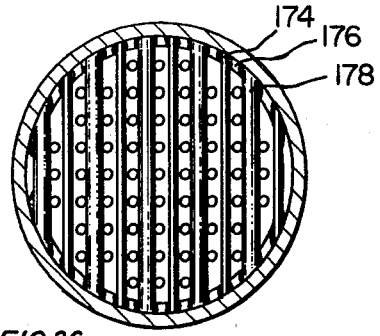

Referring to FIG. 36, there is illustrated an embodiment of the present invention wherein both non-supportive vortex generators 174 and supportive vortex generators 178 are affixed as chords to the same end of ring 176 to form a supportive/non-supportive rod baffle. The non-supportive vortex generators 174 are oriented in alternating vertical lanes defined by parallel tube rows, as are the supportive vortex generators 178. The supportive vortex generators 178 are positioned in lanes not occupied by a non-supportive vortex generators of the same rod baffle.

Figure 34:
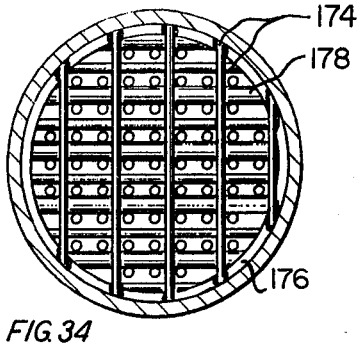

Referring to FIG. 34, there is illustrated an embodiment of the present invention wherein both supportive vortex generators 178 and non-supportive vortex generators 174 alternate in adjacent lanes defined by one plurality of parallel tube rows and non-supportive vortex generators 174 are positioned in alternating lanes defined by another plurality of parallel tube rows. As illustrated, the supportive vortex generators 178 and non-supportive vortex generators 174 on a first end of the ring 176 are affixed to the ring 176 as parallel chords, and the non-supportive vortex generators 174 on the second end of the ring 176 are affixed as parallel chords perpendicularly to the chords on the first end.

Figure 40:
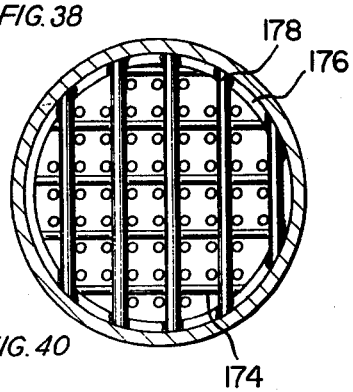

Referring to FIG. 40, there is illustrated an embodiment of the present invention wherein supportive vortex generators 178 are affixed as parallel chords to a first end of ring 176 and extend through the tube bundle in a portion of the parallel lanes defined by a first plurality of parallel tube rows, and non-supportive vortex generators 174 are affixed as parallel chords to a second end of ring 176 and extend through the tube bundle in a portion of the parallel lanes defined by a second plurality of parallel tube rows.

Figure 37:
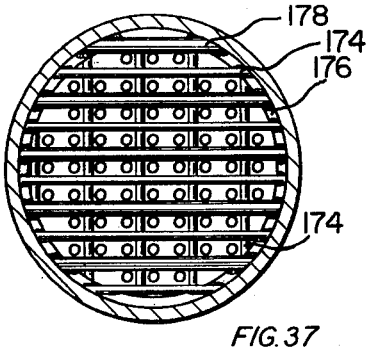

FIG. 37 is a reverse view of the baffle shown in FIG. 34.

Figure 38:
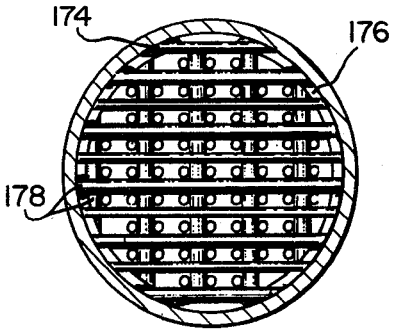

In FIG. 38, both supportive vortex generators 178 and non-supportive vortex generators 174 are affixed as parallel chords to a first end of the ring 176, and a plurality of supportive rods 178 are affixed as parallel chords to the second end of the ring 176 and oriented to pass through the lanes intersected by the supportive vortex generators 178 and non-supportive vortex generators 174 on the first end of the ring 176.

Figure 39:
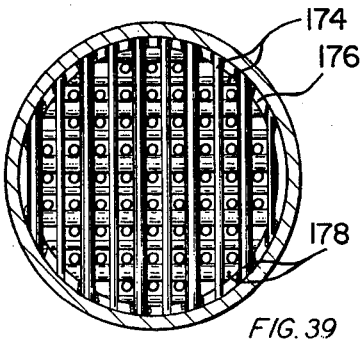

In FIG. 39, both ends of the ring 176 are provided with both supportive vortex generators 178 and non-supportive vortex generators 174. On each end of the ring, alternating supporting vortex generators 178 and non-supporting vortex generators 174 occupy the lanes defined by a plurality of parallel tube rows. On each side of the ring 176, the vortex generators are affixed to the ring 176 as chords. The vortex generators affixed to a first end of the ring 176 pass through a different plurality of parallel lanes than the vortex generators on the second end.

The following examples are given to illustrate construction and specifics of tube bundles employing representative embodiments of the present invention. The apparatuses described were not actually constructed, but are set forth as an aid for conveying a clear understanding of the present invention.

EXAMPLE I

A single pass shell and tube heat exchanger contains 137 carbon steel tubes, 9.7 feet (2.96 m) long with a 0.5 inch (1.27 cm) outside diameter, laid out on a square pitch of 0.6875 inch (1.75 cm) and having a shell diameter of 10.25 inches (26.04 cm). The heat exchanger is designed to have a tube support distance of 19.6 inches (49.78 cm).

The baffle arrangement is as illustrated in FIG. 1. Eight baffles per baffle set are employed with a spacing between baffles of 2.4 (6.1 cm) inches. The supportive rods have a circular cross section and a diameter of 0.1875 inch (0.48 cm). The non-supportive rods have a circular cross section and a diameter of 0.125 inch (0.32 cm). The rods are welded by their ends as chords to an end of a circular ring formed from 0.5 inch (1.27 cm) rod stock. Except for the diameter of the rods, the baffles are of identical construction with rod placement so as to pass through every other lane. The rods are thus attached to the rings as chords on 1.375 inch (3.49 cm) centers.

Twenty-four supportive rod baffles and twenty-four non-supportive rod baffles are placed in separate stacks and oriented in the same direction. The sides of each stack are color coded at 90° intervals with a different color.

The baffles are then welded on 4 skid bars 9.5 feet (2.9 m) long formed from ¾ inch (1.9 cm) thick by 1.87 inch (4.75 cm) wide stock. Notches are cut in the baffle rings every 90° at the color code to insure a good fit. The baffles are first mounted on a single bar at 2.4 inch (6.1 cm) center to center spacing, alternating supportive rod baffle and non-supportive rod baffle. The first rod baffle welded to the skid bar is a supportive rod baffle, and the next is a non-supportive rod baffle rotated clockwise 180° from the supportive rod baffle. The next baffle is a supportive rod baffle oriented with 90° clockwise rotation from the first rod baffle. The next rod baffle is a non-supportive rod baffle oriented with 90° clockwise rotation from the first non-supportive rod baffle, etc. When baffle placement on the first skid bar is complete, a few guide tubes are inserted into each quadrant of the cage and the bundle is rolled on the floor to finish alignment. The remaining three skid bars are welded into place to form the cage for the tube bundle. The skid bars are flush with the outside edge of the baffle ring.

The remaining tubes are then inserted into the bundle, the tube sheets installed, and the tubes rolled into the sheet.

EXAMPLE II

A single pass shell and tube heat exchanger contains 137 carbon steel tubes, 9.7 feet (2.96 m) long with 0.5 inch (1.27 cm) outside diameter laid out on square pitch of 0.6875 inch (1.75 cm), the exchanger having a shell diameter of 10.25 inches (26.04 cm). The heat exchanger has segmental plate baffles cut at about 40 percent (40 percent open area) wherein the adjacent baffles deflect the flow of shell fluid from one side of the exchanger to the other. Between each set of adjacent baffles is a pair of adjacent, spaced apart vortex generator baffles, each vortex generator baffle comprised of spaced parallel rods, each pair of vortex generator baffles having the parallel rods of one vortex generator baffle set at 90° with respect to the rods on the other vortex generator baffle.

As shown in FIG. 24, one tube support plate baffle is positioned so as to deflect the shell fluid therebeneath and the next tube support plate baffle is positioned so as to deflect the fluid thereabove.

The description will include a first section comprising a first vertical plate baffle-tube support positioned to flow shell fluid therebeneath, a next adjacent vortex generator baffle using horizontal parallel rods, a next adjacent vortex generator baffle having vertical parallel rods, a second vertical plate baffle-tube support positioned to flow shell fluid thereover, a next adjacent vortex generator baffle using vertical parallel rods and then a next vortex generator baffle using horizontal parallel rods (followed by second vertical plate baffle-tube support positioned to flow shell fluid therebeneath and thusly starting the next section or repeat of the above said first section).

The spacing between, for example, two downwardly positioned plate baffle-tube supports where the shell fluid flows beneath each baffle is 36 inches (91.4 cm).

Adjacent and spaced downstream from the first plate baffle-tube support, said support being welded to skid bars formed from ¾ inch (1.9 cm) thick by 1.87 inch (4.75 cm) wide stock, and having apertures therein to receive and support the tubes of the exchanger, is positioned the first vortex generator baffle having spaced horizontal parallel rods extending across the flow of shell side fluid. The rods are non-supportive (but can be supportive) and are positioned between the tubes, and each rod has a circular cross section and a diameter of 0.125 inch (0.32 cm). The rods are welded by their ends as parallel chords to an end of a circular holding ring formed from 0.5 inch (1.27 cm) rod stock. A rod is positioned between every other pair of adjacent tubes. The circular holding ring of the vortex generator baffle is then welded to the skid bars.

Adjacent and spaced downstream from the first vortex generator baffle is a similarly produced second vortex generator baffle having spaced vertical parallel rods extending across the flow of the shell side fluid. The same size rods are used in this second vortex generator baffle. A rod is positioned between every other tube. The rods are welded at their ends to their circular holding ring. The circular ring is welded to the skid bars.

Adjacent and spaced downstream from this second vortex generator baffle is a second plate baffle-tube support installed in the same manner as the first plate baffle-tube support, except that it is positioned so that shell fluid passes thereover. Next adjacent to and spaced from this second plate baffle is a third vortex generator baffle having spaced vertically parallel rods (as the second vortex generator baffle) with the ends of the rods welded to their circular holding ring. The circular holding ring is welded to the skid bars. A rod is positioned between every other pair of adjacent tubes. And finally, in this first section, is an adjacent vortex generator baffle having spaced parallel horizontal rods. This vortex generator baffle has the ends of its rod welded to its circular holding ring which ring is welded to the skid bars. A rod is positioned between every other pair of adjacent tubes. This makes one section which is repeated as often as required for the length of the exchanger.

EXAMPLE III

A single pass shell and tube heat exchanger contains 141 carbon steel finned tubes (Wolverine S/T Type Fin Tubes), laid out on one inch square pitch, with the fin diameters 0.026 inch (0.066 cm.) less than their plain-end diameters. Each finned-tube is 9.7 feet (2.96 m) long with a 0.75 inch (1.91 cm) plain-end outside diameter and a 0.724 inch (1.84 cm) fin diameter. A square pitch clearance of 0.25 inch (0.64 cm) between the plain ends is provided for allowing non-supportive rod clearance between the non-supportive rod and the finned section of the tube during the tubing operation. Shell diameter is 14 and ¼ inches (36.2 cm). The heat exchanger is designed to have a tube support distance of 12 inches (30.48 cm).

Figures 19, 20, 21, 22, 23:
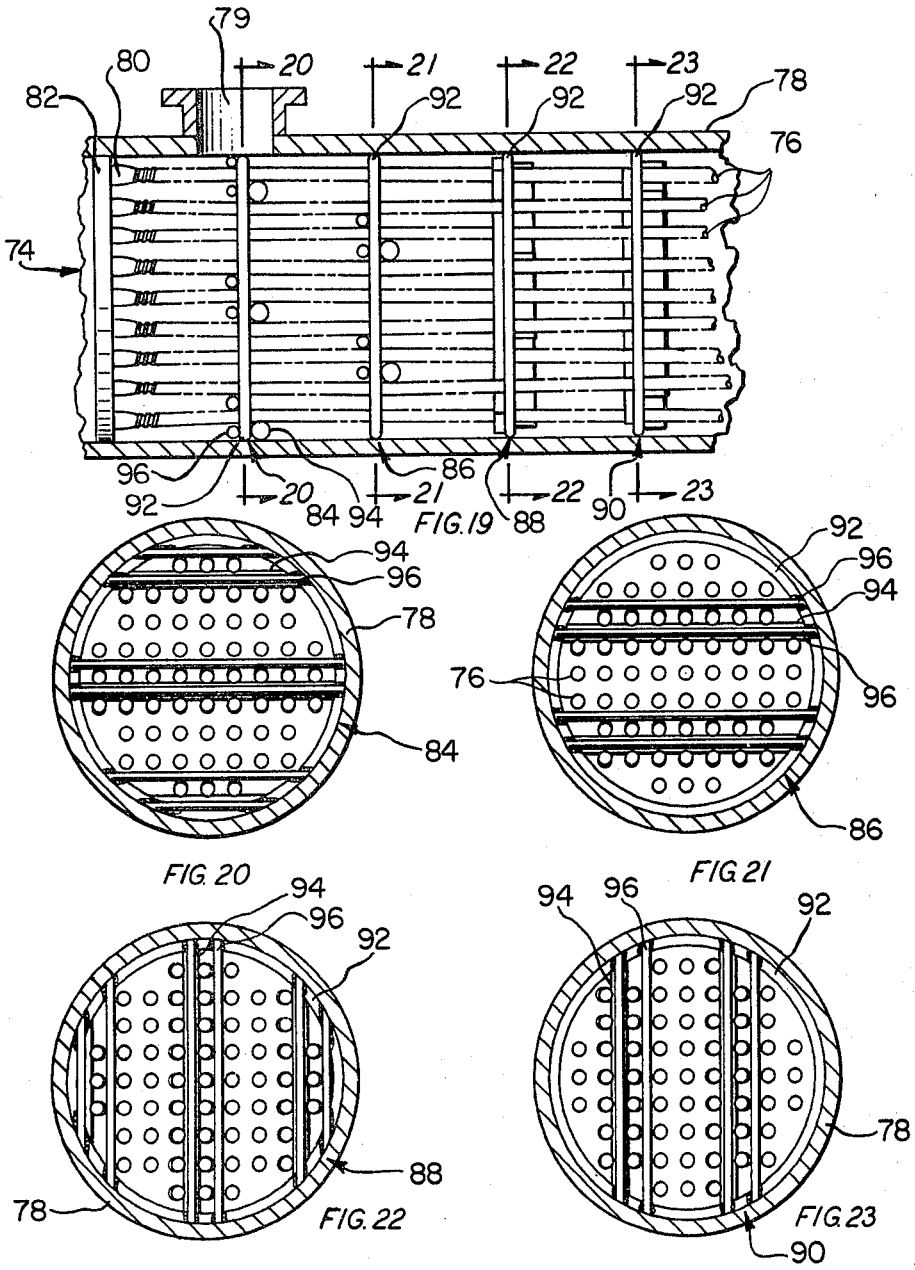
FIG. 19 illustrates another embodiment of the present invention as employed in a tube bundle having finned tubes employed in a portion of a heat exchanger shell.
FIGS. 20–23 represent plan views of the baffles of the apparatus shown in FIG. 19 as seen along the indicated lines.

The baffle arrangement is illustrated in FIG. 19. Four baffles per set are employed, one subset of two adjacent baffles having its tightening or supportive rods and non-supportive rods oriented at 90° from the tightening or supportive rods and non-supportive rods of the next adjacent subset of two adjacent baffles. The spacing between each pair of adjacent baffles is 6 inches (15.24 cm). Each tightening or supportive rod has a circular cross-section and a diameter of 0.35 inch (0.89 cm). Each non-supportive rod has a circular cross-section and a diameter of 0.25 inch (0.64 cm). The non-supportive rods are welded at their ends as chords to an end or face of a circular ring formed from ½ inch (1.27 cm) rod stock. The supportive and non-supportive rods in each baffle are parallel with respect to one another. Each oversize or tightening or supportive rod is forced into position after the finned-tubes have been assembled with the non-supportive rods between the finned section of a pair of adjacent tubes. The ends of the supportive rods are welded as a chord to an end or face of a circular ring.

In a first baffle assembly, one adjacent set of two non-supportive rods is positioned with a rod on each side of a first tube at the finned section, and the next set of two non-supportive rods is positioned with a rod on each side at a second tube position at the finned section, the second tube being spaced from the first tube by three intermediate adjacent finned-tubes. In this first baffle these non-supportive rods are welded to the circular ring associated therewith. After assembly of the non-supportive rods, the supportive rods are positioned between the tubes at their finned sections adjacent the opposite face of the circular ring to which the non-supportive rods are welded which is preferably on the upstream side of the baffle in respect to shell fluid flow. Each supportive rod is forced through the tube bundle against the fins at that locus to effect the wedging of the support rod between adjacent finned tubes. In this baffle, the support rods are inserted so as to wedge between the first finned tube and its next adjacent finned tube, so that a supportive rod is adjacent but on the opposite side of the circular ring with respect to the non-supportive ring at that locus. Additional supportive rods are similarly positioned throughout this first baffle. The supportive rods are then welded to the circular ring.

In the next baffle adjacent to this first baffle, wherein the supportive rods and non-supportive rods are parallel with respect to one another and also parallel with the rods in the first baffle, a set of two non-supportive rods is positioned with a rod on each side of the second subadjacent tube from the first tube of the above-described first baffle. Similarly, other sets of two non-supportive rods are positioned in the exchanger. These non-supportive rods are welded to the circular ring of this baffle. The non-supportive rods of the first and next adjacent baffle of this subset of two baffles are thusly arranged so that each tube has a non-supportive rod on each side thereof, and, as shown in the Figure, the first, fifth, ninth, and thirteenth tubes have non-supportive rods on each side thereof in the first baffle, and the third, seventh, and eleventh tubes have non-supportive rods on each side thereof in the next baffle adjacent the first baffle. Also, the second, sixth, and tenth tubes have non-supportive rods on each side thereof, one non-supportive rod being in the first baffle and the other non-supportive rod being in the next baffle adjacent the first baffle.

After the non-supportive rods are welded to their circular ring of this next adjacent baffle, supportive or tightening rods are inserted, as described with respect to the first baffle, and are positioned on the opposite side of the support ring of this next adjacent baffle. A supportive rod is positioned so as to wedge between adjacent finned tubes at the finned section. A supportive rod is positioned, as seen in the Figure between the third and fourth tube, between the seventh and eighth tube and between the eleventh and twelfth tube. The supportive rods are then welded to their circular ring.

As can be seen in FIG. 19, each tube is wedged by a supportive rod in each subset of two baffles; that is, a first pair of adjacent tubes is wedged by a supportive rod in the first baffle, a second adjacent pair of adjacent tubes is wedged by another supportive rod but in the next adjacent baffle of the subset of two baffles.

The next adjacent subset of two baffles of a set of four baffles per set are assembled as described with the first subset except the non-supportive and supportive rods are at 90° to the rods of the first subset of two baffles.

Skid bars of ½ inch (1.3 cm) thick and 1 and ¼ inch (3.2 cm) width are welded to the circular rings.

Reasonable variations and modifications of the present invention are possible by those skilled in the art within the scope of the described invention and the appended claims.

What is claimed is:

1. Apparatus comprising:

(a). a plurality of parallel tubes arranged to form at least a first and second plurality of parallel tube rows with lanes between adjacent tube rows;

(b). a ring surrounding said plurality of tubes in a plane about normal to said plurality of tubes;

(c). a plurality of non-supportive vortex generators affixed to and spaced across said ring, forming chords across a first end of said ring, each of said plurality of non-supportive vortex generators extending between two different adjacent tube rows of said first plurality of parallel tube rows; and (d). support means cooperating with the plurality of parallel tubes in the first and the second plurality of parallel tube rows to support the tubes in the first and second plurality of parallel tube rows.

2. Apparatus as in claim 1 wherein the support means comprises a plurality of parallel supportive vortex generators extending between adjacent tube rows in at least a portion of the lanes between adjacent tube rows, said parallel supportive vortex generators supporting adjacent tube rows.

3. Apparatus as in claim 2 wherein the plurality of parallel supportive vortex generators are affixed as chords to the first end of the ring and extend across the tube bundle in at least a portion of the first plurality of lanes not occupied by a non-supportive vortex generator, said plurality of parallel supportive vortex generators forming in combination with said ring and said plurality of non-supportive vortex generators a supportive/non-supportive rod baffle.

4. Apparatus as in claim 2 wherein the plurality of parallel supportive vortex generators are affixed as chords to a second end of the ring and extend across the tube bundle in at least a portion of the first plurality of lanes, said plurality of parallel supportive vortex generators forming in combination with said ring and said plurality of non-supportive vortex generators a supportive/non-supportive rod baffle.

5. An apparatus as in any one of claims 1–4 wherein the tube bundle further comprises a plurality of baffles.

6. An apparatus as in claim 5 wherein at least one of the baffles is a supportive rod baffle.

7. An apparatus as in claim 5 wherein the diameter of the non-supportive vortex generators is from about 10 to about 90 percent of the diameter of the supportive vortex generators.

8. An apparatus as in claim 5 wherein at least one of the baffles is a plate baffle.

9. An apparatus as in claim 5 wherein the number of tube rows in each of the first and the second plurality of parallel tube rows is an odd number.

10. An apparatus as in claim 9 wherein at least a portion of the plurality of tubes are finned tubes.

11. An apparatus as in claim 9 wherein the plurality of tubes are arranged in square pitch.

* * * * *